US006568336B2

(12) United States Patent
Van Lint

(10) Patent No.: US 6,568,336 B2
(45) Date of Patent: May 27, 2003

(54) DEVICE FOR DISPENSING A LIQUID ONTO VALUABLES

(75) Inventor: Gregory Van Lint, Hoegaarden (BE)

(73) Assignee: 3SI Security Systems, Inc., New York, NY (US)

( * ) Notice: Subject to any disclaimer, the term of this patent is extended or adjusted under 35 U.S.C. 154(b) by 0 days.

(21) Appl. No.: 09/230,101

(22) PCT Filed: Jul. 18, 1997

(86) PCT No.: PCT/BE97/00085

§ 371 (c)(1),
(2), (4) Date: Oct. 12, 1999

(87) PCT Pub. No.: WO98/03758

PCT Pub. Date: Jan. 29, 1998

(65) Prior Publication Data

US 2003/0033965 A1 Feb. 20, 2003

(30) Foreign Application Priority Data

Jul. 22, 1996 (EP) ..... 96202073

(51) Int. Cl.[7] ..... G08B 15/02
(52) U.S. Cl. ..... 109/29; 109/25
(58) Field of Search ..... 109/25, 20, 29–34, 109/42–44

(56) References Cited

U.S. PATENT DOCUMENTS 952,761 A * 3/1910 Smith
1,936,385 A * 11/1933 Dilatush ..... 109/6
3,096,940 A * 7/1963 Burleigh ..... 109/29 X
3,344,757 A * 10/1967 Touyet ..... 109/25
4,273,478 A * 6/1981 Cedergren ..... 406/189
4,607,579 A * 8/1986 Stenild ..... 109/25
4,722,435 A * 2/1988 Mareels et al. ..... 109/25 X
4,799,435 A 1/1989 Boutroy ..... 109/25
4,852,502 A * 8/1989 Klingberg et al. ..... 109/25
4,942,831 A * 7/1990 Tel ..... 109/29
5,156,272 A * 10/1992 Bourchard et al. ..... 109/25
5,196,828 A * 3/1993 Keniston ..... 340/571
5,293,990 A * 3/1994 Masakayan ..... 109/20 X
5,406,896 A * 4/1995 Jacobson ..... 109/29
5,598,793 A * 2/1997 Lopez, Jr. ..... 109/25
5,617,799 A * 4/1997 Kaczorowski ..... 109/29

FOREIGN PATENT DOCUMENTS

EP 0 623 902 A 11/1994
WO 92 07159 A 4/1992
WO 95 28542 A 10/1995

* cited by examiner

*Primary Examiner*—Gary Estremsky
(74) *Attorney, Agent, or Firm*—RatnerPrestia

(57) ABSTRACT

A device to be incorporated in a container for valuables comprises a first reservoir (3) containing a liquid coloring material or a noxious gas, preferably an ink, a second reservoir (14) containing a pressurized gas, and an actuator (13) connected to a detection system. The pressurized gas is liberated if required by the detection system. The first reservoir (3) is able to collapse under the sudden increase in pressure resulting from the release of the gas. The content of the first reservoir is ejected through a retaining valve and an elongated perforated pipe (10) for spraying the valuables.

15 Claims, 1 Drawing Sheet

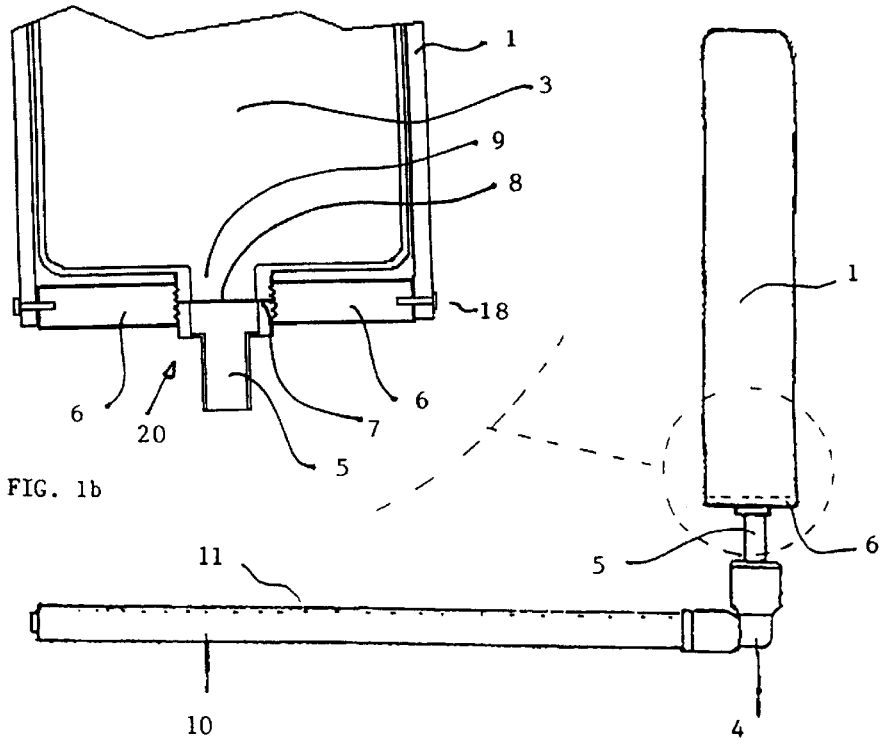
FIG. 1b
FIG. 1a
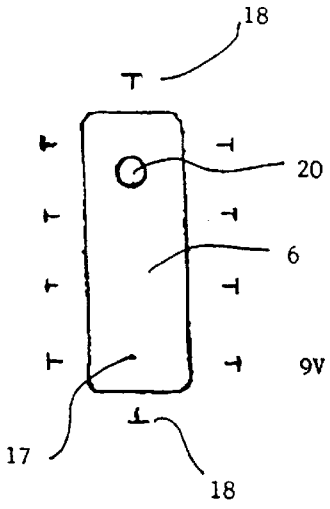
FIG. 2b
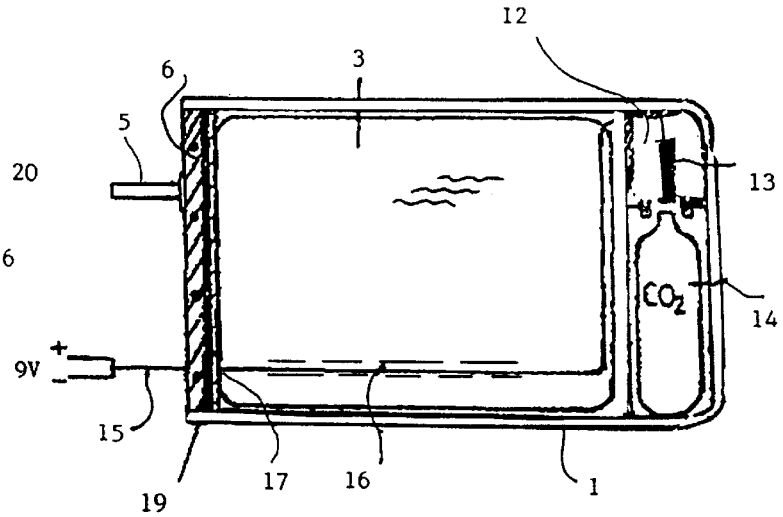
FIG. 2a

DEVICE FOR DISPENSING A LIQUID ONTO VALUABLES

The present invention is directed to a new security device for dispensing liquids, preferably an ink, onto valuables, for example bank notes such as present in a preloaded cassette used in teller cash dispensers (TCD) or automatic teller machine (ATM) or in a container for transportation.

The purpose of the device is to render valueless the bank notes in the container when there is detected a violation, an attempted theft or an unauthorised manoeuvre to displace, remove or break the container. This is detected preferably by a suitable known electronic means which is no part of the present invention.

In the case of a container for transportation, for example a suitcase, it is well know to include devices that will, in the event of a theft or an aggression, invalidate the bank notes which are contained therein. This is achieved by automatically spraying a coloured liquid, for example as a consequence of a controlled explosion. The ink will preferably be indelible and water-based.

For this purpose, several systems are known. Among them, a device is known which includes a cylinder containing the ink and a piston that will be actuated, in the case of theft, via electronic or mechanical means and possibly a CO2 cartridge or canister.

Another device comprises an ink reservoir and a CO2 cartridge which once actuated will eject the ink mixed with the gas in the container. In the latter case, a substantial portion of the ink is not delivered onto the stacks of bank notes.

These devices are complicated and not very reliable due to the presence of mechanical parts, the possibility of blockage and the high cost of the maintenance.

A first improvement disclosed in European Patent Publ. Nr. 0 623 902 A1 was achieved by providing a device with an ink reservoir comprising an elastic sealing means delimiting a second compartment capable to be inflated by a pressurised gaz liberated from a second reservoir.

However there is still a need to clean thoroughly the system after each use or during maintenance checkup.

The present invention is to overcome these problems, and is directed towards providing a new improved device for staining, preferably permanently, the bank notes in a container, such container being preferably but not necessarily for use in an automatic cash dispenser. The cost of maintenance is reduced as the ink and the pressurized gas is present in the form of removable cartridges that may be easily replaced.

According to another aspect of the invention the cartridges are disposable cartridges that may be disposed of after operation or during maintenance operations which will be run at predetermined intervals.

The unit according to one aspect of the invention has a replaceable ink cartridge, enabling the technicians to replace the ink supply on site, avoiding in that way a return to the laboratory.

According to still another embodiment of the invention, the housing containing the ink and gas cartridges is itself disposable so that no means must be provided for opening such housing after the manufacturing step.

The device according to the invention is preferably but not necessarily adapted for being fitted in a preloaded bank note cassette. Such a cassette is generally elongated and contains a stack of bank notes in a tight arrangement. The bank notes may be individually delivered through a suitable mechanism. The cassette may only be opened by authorised operators, the cover being removable or hinged to a side wall of the cassette.

In summary, the invention provides a device adapted to be incorporated in a bank note container comprising a housing which contains:

- a first reservoir, which is at least partially collapsible under external pressure, containing a liquid colouring material and comprising on a wall thereof an orifice provided with a retaining valve
- a second reservoir containing a pressurized gas
- an actuator connected to the valve of said pressurized gas reservoir and to a detection system, able to trigger the immediate and complete liberation of the pressurized gas from said second reservoir if required by said detection system, and extending outwardly from said orifice in the first reservoir, through a hole in a wall or a cover of a more rigid housing, an ink discharging means said housing containing the reservoir, the cartridge, the actuator and a means for connecting the actuator to an outside detection system.

The second reservoir may be replaced by any other element able to deliver or liberate, under pressure, in a very short time a given quantity of gas, for example CO2. It may be a pyrotechnic element known as a gas generator as used for other applications such as air bags in the automobile industry or in fire extinguishers. The gas may thus also be provided via a sudden chemical decomposition.

The ink discharging means will be preferably in the form of a perforated elongated pipe, all perforations being directed to the side where the bank notes are located. The perforations are advantageously 0.8 to 1 mm wide. There may be 50 or more of such perforations. The discharging means may also be one or several nozzles or equivalent element.

According to one embodiment of the invention, the device comprises a reservoir for liquid coloured ink. The reservoir will preferably be made of plastic material which is flexible enough to collapse as a consequence of a sudden, nearly explosive, increase of external pressure resulting from the liberation of pressurized gas contained in a rigid second removable reservoir in the form of a cartridge. The plastic may be HD polyethylene. The dimension of the ink reservoir is such that it may be inserted in the housing while leaving enough place at the end of it for the pressurised gas cartridge and the actuator. According to a particular embodiment, presently less preferred, the ink reservoir may have a bellow-like configuration, rendering the collapsing under external pressure easier.

The pressurised gas reservoir or cartridge and the actuator may be contained in, or part of, a secondary housing, also preferably made of plastic, and able to be inserted in the main hereabove mentioned housing. This secondary housing will be provided with holes or be open so that free expansion of the gas in the main housing is permitted. Its purpose is to associate correctly, in a single unit, the actuator (detonator) with the associated wire and the end of the cartridge. This is to ensure an efficient triggering operation.

The main housing may be parallelepipedic and comprises a removable side cover with an orifice for the dispensing means and a smaller orifice for the connecting means to the detection system. A O-ring is advantageously provided between the cover or lid and the rest of the body of the housing. The connecting means is usually a wire. A groove for receiving said wire may be provided in the inside wall of the housing or in the external side of the collapsible reservoir. The side cover is firmly positioned by screws or bolts. The housing and its covering plate may be of metal, for example aluminium, or of plastic material, for example glass fiber reinforced nylon. This material will be substantially more rigid than the plastic used for the ink reservoir. A slight flexibility is however acceptable, or even advantageous, as far as the resistance to a sudden internal increase in pressure is not at stake.

According to another embodiment of the invention, the housing does not comprise a removable lid or cover. In this case, all the components are indeed contained in a permanently sealed housing, the cover being for example induction sealed at the manufacturing stage. The housing is then disposable after use or after a predetermined time in operation.

The housing is provided preferably with integral attachment means for its fixation into or adjacent to the container with the valuables. Attachment may also be provided for a printed circuit board located parallel to a surface of the housing, such circuit board being a part of the detection system.

According to one aspect of the invention, the pressurized gas cartridge or equivalent means, possibly together with an actuator, possibly screwed to the body of a element of the housing or of the ink reservoir, is able to liberate the pressurized gas, for example by way of a controlled explosion produced by a detonator in order to break, in a known way, a weak region of the head of the cartridge. Electronic means provides the suitable signal (for example 9V) when such action is required.

The pressurized gas in the cartridge may be air but will be preferably carbon dioxide at a pressure of +/−50 kg/cm2.

According to one embodiment of the invention, the outlet pipe of the ink reservoir is connected to a retaining valve and, via an 90° elbow, to an ink distributing means, such as a pipe perforated on its entire length or one or a plurality of nozzles directed, when adapted to a bank notes cassette, towards the stack of bank notes. Such means will extend along at least one internal side of the container, for example along the cover thereof.

The outlet and the main reservoir is tightly secured to the cover of the housing via means such as a threaded bore and its counterpart in the cover or the wall of the housing.

In operation, the collapsible reservoir will push said ink through the retaining valve into the distributing means, for example one or several perforated pipes locate above the stack of bank notes, and then on and into the bank note stack or stacks of the cassette. Preferably, the collapsing will result from at least two main walls of the ink reservoir being deformed and pressed one against or towards the other by the homogeneous external pressure of the gas.

After operation, the ink reservoir will generally be substantially flattened, more than 90%, in some case more than 95%, of the content having been ejected. The remaining pressure in the main housing will decreased naturally, the sealing being not perfect, or a special vent may be provided for this purpose.

The suitable valve located between the reservoir and the pipe will allow passage of the ink, for example only at pressure above a few kg, preferably less than 5 bars. Typically the air pressure in the cartridge, immediately following the actuation, will be 50 kg and more than 90% of the ink will be ejected from the reservoir through the discharging means.

The above retaining valve may be a ball-spring type one way valve or according to a preferred embodiment a cheaper membrane, for example made of plastic or metallised plastic, suitably sealed, that will rupture above a given pressure, that is to say for example between 3 and 6 bars.

The membrane will rupture at its center under the pressure of the fluid being squeezed out by the collapsible container.

This membrane is preferably glued, sealed, hot plated or welded for example by induction, to the end of the outlet of the housing. It will therefore act as a sealant and as a break valve with no adjustment and leaking which are the drawbacks of the conventional relief valves.

According to a particular embodiment, the rupture valve may be made of a sandwiched film (e.g. 30 micron plastic and 40 micron aluminium). In the manufacturing process, after the collapsible bottle is filled, the film is hotplated on the top of the bottle. After hotplating, the metal is etched away in a known way, only leaving the plastic film as a seal. This member works both as a seal and as a break or rupture valve. The seal will withstand pressure of 5 bar, yet the seal will consistently break at 8 bar. If during the etching process a pattern is etched (for example a slot), then the breakage of the seal will follow the pattern, a feature which might be advantageous for specific applications (e.g. large seals). A further advantage associated with the use of such a rupture valve is that when the system activates and the break valve ruptures, the plastic remains of the seal stay attached to the housing. This prevents blockage of the discharging means.

According to one embodiment of the invention, the device, including the valve and the dispensing means, preferably the perforated pipe, is fixed by conventional means to the internal side of the upper cover which is hinged to the body of a cassette. The cassette is adapted to contain a stack of bank notes for cash dispenser. The electronic circuit and the power supply (battery) which are a part of the detection system is preferably adjacent to the body of the device.

The device according to the invention may be incorporated in valuable containers other than bank note dispensers, for example in safes, suitcases or within security vans.

The invention will be more clearly understood from the following description of one embodiment thereof, given by way of example only, with reference to the accompanying drawings in which FIG. 1*a* illustrates the device one embodiment of the invention with a particular type of discharging means FIG. 1*b* is a enlarged sectional view of the head of a housing according to the invention and FIG. 2*a* and 2*b* illustrate more particularly a specific arrangement in the housing.

Referring to FIGS. 1*a* and 1*b,* the system of the invention comprises a housing 1, a spray bar 10 connected (via means not shown) to an aqueous ink reservoir 3 via a 90° elbow 4 fitted in a transition piece 5, itself screwed half way through a threaded hole 20 in the lid 6. This piece 5 presses on the periphery 7 of the membrane 8 glued at the end of the outlet part 9 of the ink reservoir. This part 5 is also half way screwed on the internal side of the lid 6 of a housing 1. The piece 5 may be made of transparent plastic so that a visual control of any possible leakage is rendered possible. The spray bar 10 is a pipe provided with 50 small holes 11 directed towards the valuables. The housing and the bar are made of essentially rigid glass-fiber reinforced nylon.

FIG. 2*a* and 2*b* show the internal arrangement in the housing containing a collapsible parallelepipedic bottle 3 (ink reservoir) made of high density polyethylene occupying the larger portion of the housing and a secondary compartment 12, located at the bottom end of the main housing 1 and containing a detonator 13 and a CO2 bulb 14. The detonator or pyrotechnic member 12 is connected via a wire 15 running in a groove 16 along one external side of the bottle, and through a second smaller hole 17 in the lid 6, to the electronic detection system. This second hole in the housing is tightly sealed by the wire and any conventional means in order to prevent significant leakage when the system is actuated. The lid is removable so that all internal elements are accessible and also removable. The lid is secured to the body of the housing 1 by self tapping screws 18. Between the lid and the body a conventional O-ring 19 is also inserted in order to ensure tightness.

An ink suitable for use in the device of the invention is disclosed in European Patent Application Publ. Nr. 0 623 658 A1. The ink as mentioned in the above description may be replaced, for specific applications, by any other colouring liquid or noxious gas.

The invention is not at all limited to the embodiments described and/or illustrated which have been given by way of examples only.

What is claimed is:

1. A security device to be incorporated in a container for valuables comprising:

(a) a sealed housing for placing in said container for valuables, said housing having an outlet port;

(b) a replaceable collapsible container, sealed by sealing means and separate from, but located within, said housing, containing a liquid coloring material or noxious gas and connected through said sealing means to said outlet port, said collapsible container being accessible and removable from said housing without discharge of the liquid coloring material or noxious gas;

(c) gas liberating means for releasing gas suddenly into the interior of said housing outside said replaceable collapsible container for contacting, compressing and collapsing said replaceable collapsible container; and (d) an actuator arranged to liberate gas from said gas liberating means in response to a signal emanating from an electronic detection system external to said housing;

whereby release of said gas from said gas liberating means causes said replaceable collapsible container to collapse to force said liquid coloring material or noxious gas through said sealing means and outlet port.

2. The device according to claim 1 wherein the gas liberating means is a reservoir containing pressurized gas within said housing.

3. A device according to claim 2 wherein the reservoir containing pressurized gas is a replaceable cartridge of said pressurized gas.

4. A device according to claim 3 wherein the sealed collapsible container is secured to the removable cover of the housing.

5. The device according to claim 1 wherein the sealing means is a rupturable membrane.

6. The device according to claim 1 wherein the sealing means is a spring-loaded ball valve.

7. A device according to claim 1 wherein said housing is sealed by a removeable cover, whereby removal of said cover from said housing permits access to and replacement of said collapsible container.

8. A device according to claim 1 wherein the sealed collapsible container is mounted in the housing by means of a threaded bore and its counterpart in the housing.

9. A container for valuables provided with a security device comprising:

(a) a detector system providing an electronic signal upon an unauthorized maneuver to displace, remove and/or break the container:

(b) a sealed housing having an outlet port connected to ink discharging means positioned to dispense ink over valuables in said container;

(c) a replaceable, collapsible container, sealed by sealing means and separate from, but located within, said housing containing a liquid ink and connected through said sealing means to said outlet port, and said collapsible container being accessible and removable from said housing without discharge of the liquid ink;

(d) gas liberating for releasing gas suddenly into the interior of said housing outside said replaceable collapsible container for contacting, compressing and collapsing said replaceable collapsible container; and (e) an actuator arranged to liberate gas from said gas liberating means in response to a signal from said detection system;

whereby release of said gas from said gas liberating means causes said replaceable collapsible container to collapse to force said ink through said sealing means, outlet port, and discharging means.

10. The container according to claim 9 in the form of a cassette for bank notes.

11. A container according to claim 9 wherein the replaceable collapsible container is sealed by sealing means comprising a rupturable membrane, whereby release of said gas from said gas liberating means causes said replaceable collapsible container to collapse, to force said ink to rupture said membrane and flow through said outlet port and discharging means.

12. A container according to claim 9 wherein the gas liberating means is a replaceable cartridge of said pressurized gas located within said housing.

13. A container according to claim 9 wherein said housing is sealed by a removeable cover, whereby removal of said cover from said housing permits access to, and replacement of, said collapsible container.

14. A container according to claim 13 wherein the sealed collapsible container is secured to the removeable cover of the housing.

15. A container according to claim 9 wherein the sealed collapsible container is mounted in the housing by means of a threaded bore and its counterpart in the housing.

* * * * *